US008755726B2

(12) United States Patent
Sugimoto

(10) Patent No.: US 8,755,726 B2
(45) Date of Patent: Jun. 17, 2014

(54) FIXING BELT AND FIXING APPARATUS

(71) Applicant: Canon Kabushiki Kaisha, Tokyo (JP)

(72) Inventor: Hiroto Sugimoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/750,174

(22) Filed: Jan. 25, 2013

(65) Prior Publication Data

US 2013/0202333 A1 Aug. 8, 2013

(30) Foreign Application Priority Data

Feb. 3, 2012 (JP) ..... 2012-022280

(51) Int. Cl.
*G03G 15/20* (2006.01)

(52) U.S. Cl.
USPC ..... 399/329

(58) Field of Classification Search
USPC ..... 399/162, 302, 308, 329, 333; 219/216; 430/124.32, 124.33, 124.35; 428/220, 428/327, 339, 473.5, 458
See application file for complete search history.

(56) References Cited

U.S. PATENT DOCUMENTS

| | | | | |
|---|---|---|---|---|
| 5,182,606 | A * | 1/1993 | Yamamoto et al. | 399/335 |
| 6,564,033 | B2 | 5/2003 | Zhou et al. | |
| 6,670,044 | B2 * | 12/2003 | Shida et al. | 428/458 |
| 6,778,802 | B2 * | 8/2004 | Kabata et al. | 399/303 |
| 7,212,776 | B2 * | 5/2007 | Takagi et al. | 399/333 |
| 7,979,001 | B2 * | 7/2011 | Miyata et al. | 399/122 |
| 8,114,500 | B2 * | 2/2012 | Yasuda et al. | 428/147 |
| 8,247,066 | B2 * | 8/2012 | Wu | 428/323 |
| 8,606,164 | B2 * | 12/2013 | Uekawa et al. | 399/330 |
| 2005/0249527 | A1 * | 11/2005 | Kuramoto | 399/302 |
| 2008/0213605 | A1 * | 9/2008 | Briney et al. | 428/473.5 |
| 2009/0252957 | A1 * | 10/2009 | Kasumi et al. | 428/349 |
| 2011/0177238 | A1 * | 7/2011 | Aoto et al. | 427/152 |

FOREIGN PATENT DOCUMENTS

| | | | |
|---|---|---|---|
| JP | 05330263 | A * | 12/1993 |
| JP | 2001-341231 | A | 12/2001 |
| JP | 2002-258648 | A | 9/2002 |
| JP | 2004-12669 | A | 1/2004 |
| JP | 2005-121825 | A | 5/2005 |
| JP | 2009075154 | A * | 4/2009 |

* cited by examiner

*Primary Examiner* — Robert Beatty
(74) *Attorney, Agent, or Firm* — Fitzpatrick, Cella, Harper & Scinto

(57) ABSTRACT

A fixing belt includes: a base layer formed of a nickel alloy; and a surface layer provided on said base layer, said surface layer having a thickness and being formed of a first polyimide resin material. The surface layer includes a filler dispersed therein and having an average particle size not less than the thickness. The filler is formed of a second polyimide resin material.

8 Claims, 3 Drawing Sheets

FIXING BELT AND FIXING APPARATUS

FIELD OF THE INVENTION AND RELATED ART

The present invention relates to a fixing belt and a fixing apparatus including the fixing belt. The fixing belt and the fixing apparatus are used in, e.g., an image forming apparatus such as a copying machine, a printer or a facsimile machine.

In an image forming apparatus of an electrophotographic type, a fixing apparatus (fixing device) for heating a recording material, on which a toner image is formed, to melt and pass the toner image thereby to fix the toner image on the recording material. A fixing belt used in the fixing apparatus employs a nickel alloy as a base material in many cases.

Such a fixing belt has a relation to an urging pad (urging member), for forming a fixing nip when the fixing belt is rotated, such that an inner peripheral surface of the fixing belt slides on the urging pad and therefore is required to have not only heat resistance but also mechanical strength. Therefore, the fixing belt may preferably be provided with a resin (material) layer of a polyimide resin material.

Such a resin layer is formed by applying, drying and baking a polyimide varnish through a known method. In this case, e.g., a solvent is volatilized by drying at about 120° C. and then imidization reaction is made at about 180° C. Then, high-temperature baking in which the temperature is stepwisely increased to 200° C. or more and up to about 400° C. A maximum baking temperature at this time determines strength as polyimide. The maximum baking temperature varies depending on a type of the polyimide resin material, but about 300° C. or more is recommended as the maximum baking temperature in many cases.

On the other hand, the nickel alloy (layer) used as a base layer (base material) of the fixing belt has a heat-resistant temperature of about 250° C. When the temperature exceeds the heat-resistant temperature, a composition or the like of the metal is changed, thus causing a lowering in mechanical strength. Therefore, in order to form the above-described polyimide resin layer on an inner peripheral surface of the nickel alloy (layer), it is preferable that the baking temperature is suppressed to about 250° C. From such a viewpoint, in Japanese Laid-Open Application (JP-A) 2001-341231, a technique for forming a polyimide film having a good anti-wearing property by limiting the baking temperature to about 250° C. and limiting a degree of imidization to 70-93% is proposed.

Further, in JP-A 2004-12669, a technique for forming a polyimide film having a good anti-wearing property by using a cyclodehydrating agent to increase the degree of imidization to 95-100% is also proposed.

However, in the case of the technique described in JP-A 2001-341231, the degree of imidization of the polyimide resin material is 70-93% and therefore is insufficient to further enhance the anti-wearing property of a fixing belt. Further, in the case of the technique described in JP-A 2004-12669, even when the cyclohydrating agent is used, the polyimide resin material is baked at about 300° C. in order to increase the degree of imidization, so that the baking temperature is unavoidably higher than a heat-resistance temperature of the nickel alloy.

SUMMARY OF THE INVENTION

A principal object of the present invention is to provide a fixing belt and a fixing apparatus which are capable of improving an anti-wearing property of the fixing belt.

According to an aspect of the present invention, there is provided a fixing belt comprising: a base layer formed of a nickel alloy; and a surface layer provided on said base layer, the surface layer having a thickness and being formed of a first polyimide resin material, wherein the surface layer comprises a filler dispersed therein and having an average particle size not less than the thickness, and wherein the filler is formed of a second polyimide resin material.

According to another aspect of the present invention, there is provided a fixing apparatus comprising: a fixing belt for fixing an image on a sheet at a fixing nip; a nip-forming member for forming the fixing nip between itself and the fixing belt; and an urging member for urging the fixing belt toward the nip-forming member, wherein the fixing belt includes a base layer formed of a nickel alloy, and a surface layer provided on said base layer, the surface layer having a thickness and being formed of a first polyimide resin material, wherein the surface layer comprises a filler dispersed therein and having an average particle size not less than the thickness, and wherein the filler is formed of a second polyimide resin material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
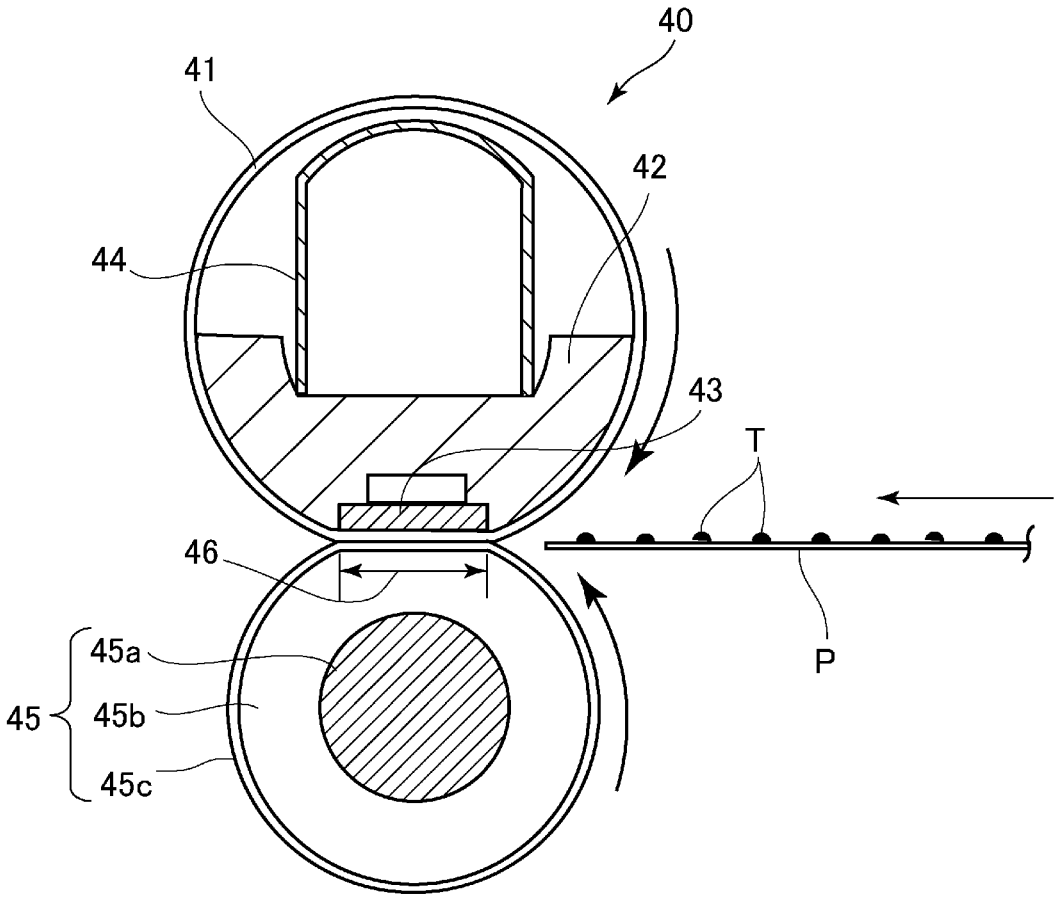
FIG. 1 is a schematic sectional view of an image heating apparatus according to an embodiment of the present invention.

Embodiments of the present invention will be described with reference to FIGS. 1 to 4. First, a fixing apparatus (image heating apparatus) in this embodiment will be described with reference to FIG. 1.

[Fixing Apparatus]

A fixing apparatus (fixing device) 40 in this embodiment is of a heater heating type using a ceramic heater as a heating means. That is, the fixing apparatus 40 includes a fixing belt (heating belt) 41 which is an endless belt, a ceramic heater 43 which is also an urging member, a belt guide member 42 which is a slidable member, and a pressing roller 45 which is a nip-forming member.

The fixing belt 41 is, as described later, the endless belt which is prepared by forming a resin layer at an inner peripheral surface of a base layer (base material) constituted by the nickel alloy and on which the belt guide member 42 and the ceramic heater 43 slide at the inner peripheral surface in a usage (operation) state. Such a fixing belt 41 is rotated by rotation of the pressing roller 45 described later. For this reason, the fixing belt 41 is rotatably supported, at its end portions with respect to a rotational axis direction, by an unshown fixing portion such as a frame of the fixing apparatus 40.

Inside the fixing belt 41, the belt guide 42, the ceramic heater 43 and a supporting member 44 are provided. The supporting member 44 is disposed inside the fixing belt 41 with respect to the rotational axis direction of the fixing belt 41 and is supported at its end portions by the unshown fixing portion such as the frame of the fixing apparatus 40. The supporting member 44 supports the belt guide member 42.

The belt guide member 42 is disposed along the supporting member 42 with respect to the rotational axis direction and guides the rotation of the fixing belt 41 by causing an outer peripheral surface thereof formed in a partly cylindrical surface shape to slide on the inner peripheral surface of the fixing belt 41. Further, at a position which is a part of the belt guide member 42 and which is a contact position with the inner peripheral surface of the fixing belt 41, the ceramic heater 43 is disposed.

The ceramic heater 43 is made of aluminum nitride and is engaged in a groove provided by molding to the belt guide member 42 along a longitudinal direction of the belt guide member 42, thus being fixed and supported. Also the ceramic heater 43 is caused to slide on the inner peripheral surface of the fixing belt 41.

The pressing roller 45 is constituted by a core metal 45*a* of stainless steel, an elastic layer 45*b* of a silicone rubber, and a surface layer 45*c* of a fluorine-containing resin tube for improving a parting property. The core metal 45*a* is rotatably supported by an unshown fixing portion at its end portions. Such a pressing roller 45 is connected with a rotation driving device (not shown) and is rotationally driven during use. Further, the pressing roller 45 is urged toward the fixing belt 41 by an unshown urging means such as a spring to form a nip (fixing nip) 46, between itself and the fixing belt 41, where a recording material P passing through the nip 46 is to be heated. Therefore, by the rotation of the pressing roller 45, the fixing belt 41 is rotated. To the nip 46, the recording material P on which an unfixed toner image formed at an image forming portion of an image forming apparatus is held is conveyed. Then, at the nip 46, the recording material is nipped and conveyed to be subjected to heating and pressing, so that a toner image T is fixed on the recording material P.

[Fixing Belt]

Figure 2:
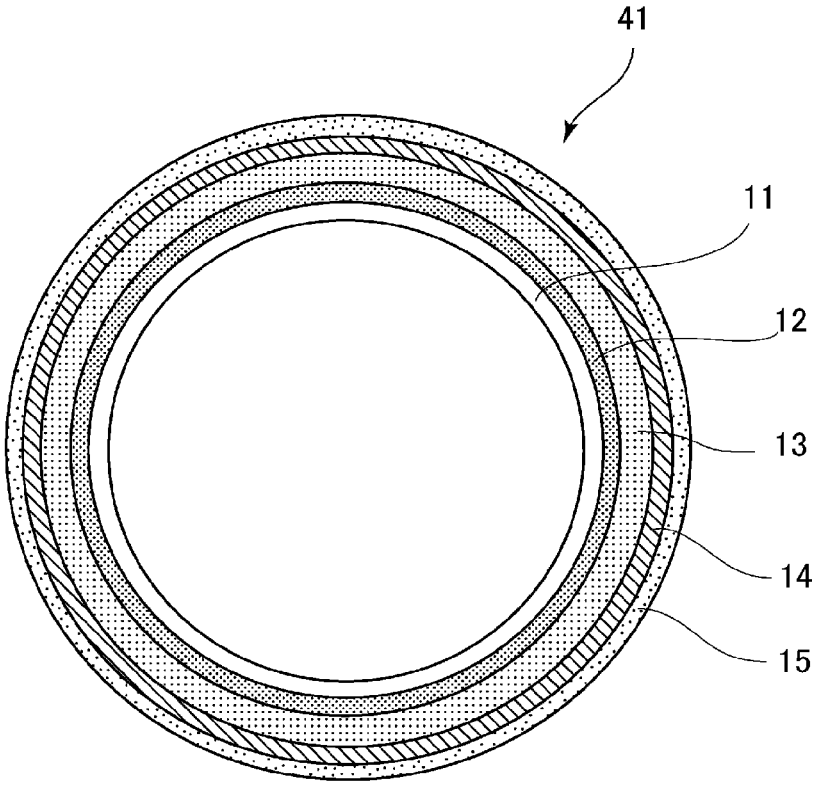
FIG. 2 is a schematic sectional view of a fixing belt.
Figure 3:
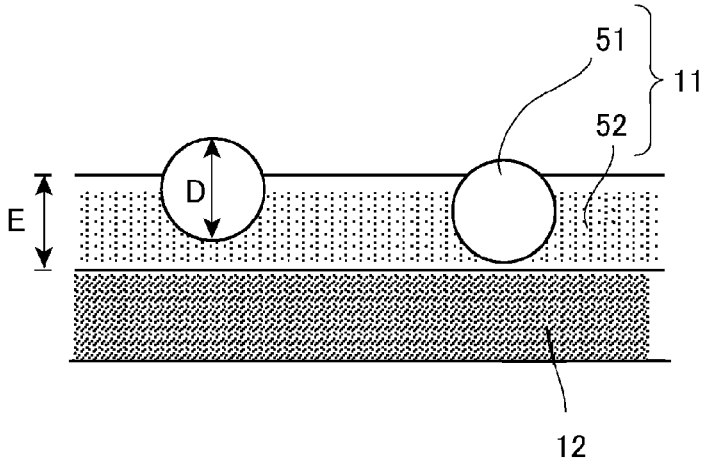
FIG. 3 is a schematic sectional view of a polyimide resin material layer.
Figure 4:
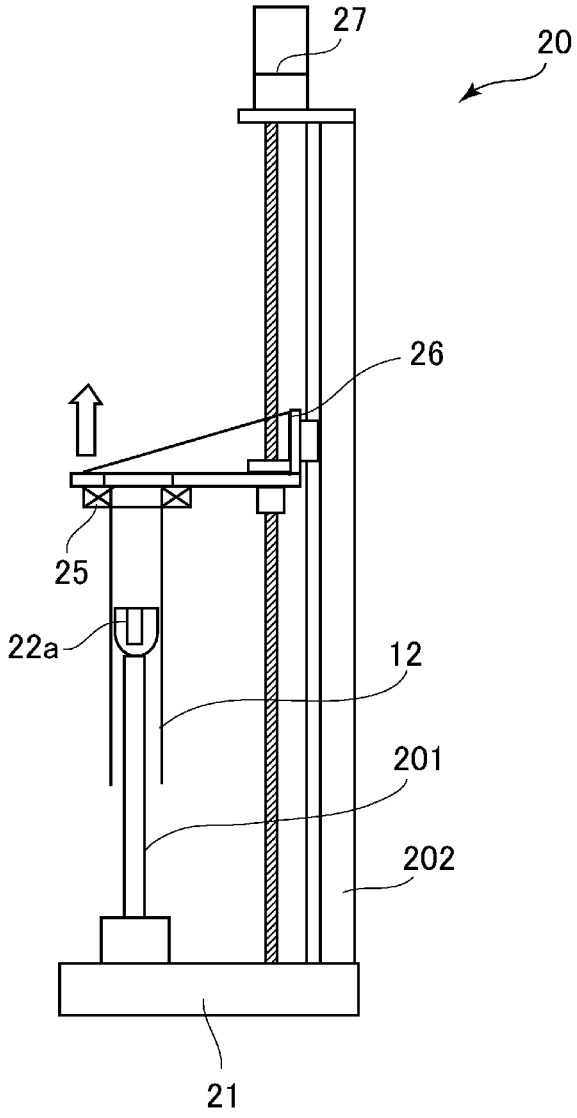
FIG. 4 is a schematic view of a coating apparatus of the polyimide resin material layer.

The fixing belt 41 in this embodiment will be described with reference to FIGS. 2 to 4. The fixing belt 41 is, as shown in FIG. 2, the endless belt formed from its inside by superposing a resin layer 11, a base layer (base material) 12 of nickel alloy, an elastic layer 13, an adhesive layer 14 and a surface layer 15.

The nickel alloy base layer 12 is an endless metal belt formed by an electroplating method in which the belt is obtained in a sulfamate bath or a sulphate bath. For example, nickel alloy disclosed in JP-A 2002-258648, JP-A 2005-121825, or the like can be used for the base layer (base material). Specifically, a nickel (90 wt. % or more)—iron alloy in which sulfur, phosphorus, carbon and the like are added may be used.

The elastic layer 13 is a silicone rubber layer which coats the outer peripheral surface of the nickel alloy base layer 12. Such an elastic layer 13 functions so as to closely cover the toner when the toner is fixed on the recording material passing through the nip. In order to perform such a function, the elastic layer 13 is not particularly limited but it is preferable that the elastic layer 13 is formed by curing an addition-curing type silicone rubber material in view of a processing property. Further, the elastic layer 13 may contain a filler for improving thermal conductivity and heat-resistant property. From the viewpoints of contribution to surface hardness of the fixing belt and an efficiency of heat conduction to the unfixed toner during the fixing, a thickness of the silicone rubber layer may preferably be about 200 μm to about 500 μm.

The surface layer 15 is a layer of a fluorine-containing resin material. As the fluorine-containing resin material, tetrafluoroethylene-perfluoro(alkyl vinyl ether) copolymer (PFA), polytetrafluoroethylene (PTFE), tetrafluoroethylene-hexafluoropropylene copolymer (FEP), and the like can be used. The surface layer 15 is formed by molding such a resin material in a tube shape. It is possible to select a material, a thickness, a coating method, and the like in consideration of a molding property, a toner parting property, surface hardness as the fixing member, and the like. By the surface layer 15, the toner is less deposited on the fixing belt 41. The surface layer 15 is disposed above the elastic layer 13 via the adhesive layer 14 of a silicone material.

[Resin Layer]

The resin layer 11 is formed on the inner peripheral surface of the nickel alloy base layer 12. Such a resin layer 11 is, as shown in FIG. 3, formed by dispersing (distributing) particles of a second polyimide resin material 51 in a first polyimide resin material 52 to be applied onto the inner peripheral surface of the nickel alloy base layer 12. The second polyimide resin material 51 is higher in mechanical strength than the first polyimide resin material 52 and has an average particle size D which is not less than a thickness E of a layer of the first polyimide resin material 52.

For this reason, the second polyimide resin material 51 is higher in degree of imidization than the first polyimide resin material 52. Specifically, the degree of imidization of the second polyimide resin material 51 is 95% or more, and the degree of imidization of the first polyimide resin material is 70% or more and 90% or less. Here, a high mechanical strength means that at least one of tensile strength (breaking strength), elastic modulus and hardness is high (large).

Further, the second polyimide resin material 51 can be baked separately from the first polyimide resin material 52 and therefore a baking temperature of the second polyimide resin material 51 can be made high. In this embodiment, as described later, the baking temperature is 400° C. As a result, the degree of imidization of the second polyimide resin material 51 can be made higher than that of the first polyimide resin material 52 and therefore can be at least 95% (95% or more).

On the other hand, the first polyimide resin material 52 is baked in a state in which it is applied onto the inner peripheral surface of the nickel alloy base layer 12, and therefore its baking temperature (230° C.) depends on a heat-resistant temperature (about 250° C.) of the nickel alloy base layer 12. For this reason, the degree of imidization of the first polyimide resin material 52 is 70% or moved and 90% or less.

Further, the average particle size D of the second polyimide resin material 51 is 100% or more and 200% or less of the layer thickness E of the first polyimide resin material 52. As a result, in a state in which the particles of the second polyimide resin material 51 are dispersed in the first polyimide resin material 52, as shown in FIG. 3, the second polyimide resin material 51 constitutes a projection projected from the layer of the first polyimide resin material 52. That is, the second polyimide resin material 51 having the high mechanical strength projects from the inner peripheral surface of the resin layer 11.

A manufacturing method of the fixing belt will be described.

(1) A cylindrical nickel alloy (member) is prepared.

(2) Particles of the second polyimide resin material are formed as a filler at a baking temperature (400° C.) higher than a heat-resistant temperature (250° C.) of the nickel alloy.

(3) The filler is dispersed in the first polyimide resin material.

(4) The first polyimide resin material in which the filler is dispersed is applied onto the nickel alloy layer.

(5) The first polyimide resin material applied on the nickel alloy layer is based at a baking temperature (230° C.) lower than the heat-resistant temperature (250° C.) of the nickel alloy.

In the case, as described later, in the application step (4), the polyimide resin material is applied onto the nickel alloy layer so that the average particle size of the filler is not less than the layer thickness of the first polyimide resin material.

Further, the second polyimide resin material as the filler is baked so that the degree of imidization thereof is higher than that of the first polyimide resin material in which the filler is to be dispersed.

Further, the second polyimide resin material as the filler is baked so that the degree of imidization is 95% or more, and the first polyimide resin material in which the filler is to be dispersed is baked so that the degree of imidization is 70% or more and 90% or less.

Here, the average particle size of the second polyimide resin material 51, the layer thickness of the first polyimide resin material 52, and the degree of imidization are measured in the following manners.

[Measurement of Average Particle Size and Layer Thickness]

A measuring method of the average particle size of the second polyimide resin material 51 and the layer thickness of the first polyimide resin material 52 will be described. In this embodiment, in order to obtain the resin layer 11 having a cross-sectional structure as shown in FIG. 3, cross-section observation of a film during completion of the resin layer 11 is used as a reference. That is, after the fixing belt is prepared, the cross-section of the resin layer 11 is observed through an electron microscope such as SEM (scanning electron microscope) and then image processing is effected to calculate the average particle size D and the layer thickness E. With respect to the average particle size D, at least 50 particles of the second polyimide resin material 51 are subjected to the measurement and statistical processing, and then a value which is most frequently obtained for the particles is determined as the average particle size D of the second polyimide resin material 51. With respect to a diameter (particle size) of each of the particles of the second polyimide resin material 51, a maximum diameter is used as the diameter of each of the particles of the second polyimide resin material 51. Further, with respect to the layer thickness E of the first polyimide resin material 52, a thickness of a layer from which the projected portion of the resin layer 11 (a region where the second polyimide resin material is projected from a flat surface portion of the resin layer 11) is removed is measured at several positions, and then an average of the measured values is obtained as the layer thickness E of the first polyimide resin material 52.

[Measurement of Degree of Imidization]

The degree of imidization is a ratio of an amount of imide ring generated by reaction to an amount of the imide ring when the reaction is completely ended. In this embodiment, measurement of the degree of imidization was performed in the following manner. First, FTIR (Fourier-Transform Infrared Absorption Spectrometry)/ATR (Attenuated Total Reflection) measurement of the surface of the resin layer is made. Then, a ratio of a peak absorbance in the neighborhood of 1773 $cm^{-1}$ on the basis of C=0 vibration of the imide ring to a peak absorbance in the neighborhood of 1514 $cm^{-1}$ on the basis of skeletal vibration of benzene ring is obtained. Then, the ratio at the baking temperature of 400° C. is obtained on the assumption that the degree of imidization of the same polyimide resin material when baked at 400° C. is 100%. The degree of imidization (%) is obtained according to the following equation.

$$\text{Degree of imidization}(\%)=(a/b)/(A/B)\times 100$$

a: peak absorbance in the neighborhood of 1773 $cm^{-1}$ b: peak absorbance in the neighborhood of 1514 $cm^{-1}$ A: peak absorbance in the neighborhood of 1773 $cm^{-1}$ during baking at 400° C.

B: peak absorbance in the neighborhood of 1514 $cm^{-1}$ during baking at 400° C.

Next, the resin layer 11 will be described more specifically. As described above, the second polyimide resin material 51 constitutes the projection of the resin layer 11. Therefore, the projection is in sliding relation with the ceramic heater 43 and the belt guide member 42 (FIG. 1) which are an urging member (contact member), thus performing the function of causing the resin layer 11 to be less worn. As the second polyimide resin material 51, substantially spherical powder (or dispersion) is used, and the layer thickness of the resin layer 11 excluding the projected portion (i.e., the layer thickness of the first polyimide resin material 52) of about 5 μm to about 20 μm may preferably be selected. Incidentally, the second polyimide resin material 51 can be manufactured by various methods, but its shape is not limited to the substantially spherical shape and varies depending on the manufacturing method. For example, in the case where the second polyimide resin material 51 is manufactured by a pulverization method, its shape is not spherical.

In the case where the layer thickness is thin, by a decrease in film thickness due to the wearing, a lifetime of the fixing belt 41 becomes short, and in the case where the layer thickness is thick, by sliding wearing, the resin layer 11 is liable to be parted. Further, as a material for the second polyimide resin material 51, a material (type of polyimide resin material) excellent in anti-wearing property may preferably be selected. Therefore, in this embodiment, the polyimide resin material which is a single material having a high mechanical strength in terms of the breaking strength, the elastic modulus, the hardness or the like is selected. Further, as another method, it is also possible to use particles of a plurality of types of polyimide resin materials in mixture as the particles of the second polyimide resin material 51.

The first polyimide resin material 52 performs the function of holding the second polyimide resin material 51 and of boding the second polyimide resin material 51 to the nickel alloy base layer 12. It is preferable that dropping of the second polyimide resin material 51 from the first polyimide resin material 52 and peeling-off of the second polyimide resin material 51 from the nickel alloy base layer 12 due to the sliding wearing with the urging member are prevented.

Further, the second polyimide resin material 51 and the first polyimide resin material 52 are required to satisfy the following relationship in order to exclusively perform their functions. That is, the average particle size of the second polyimide resin material 51 may preferably be 100% to 200% of the layer thickness of the first polyimide resin material 52. In the case of less than 100%, the second polyimide resin material 51 is buried in the first polyimide resin material 52, so that an effect of the anti-wearing property cannot be obtained. Further, in the case of exceeding 200%, the second polyimide resin material 51 is excessively projected from the first polyimide resin material 52 and therefore a possibility of the dropping of the second polyimide resin material 52 becomes high due to the sliding with the urging member.

Next, a manufacturing method of the resin layer 11 will be described. With respect to coating, drying and baking, various known methods can be employed. However, a method in which the second polyimide resin material 51 is mixed in the first polyimide resin material 52 (varnish), followed by coating, drying and baking is preferred.

That is, the second polyimide resin material 51 is baked in advance at the baking temperature which is sufficiently higher than the baking temperature (about 230° C.) of the first polyimide resin material 52 and which is naturally higher than the heat-resistant temperature (about 250° C.) of the nickel alloy, thus being formed in particles having a predetermined average particle size. As a result, the degree of imidization is 95% or more. Then, the particles of the second polyimide resin material 51 is mixed and dispersed in the first polyimide resin material 52, thus being uniformly dispersed in the first polyimide resin material 52. Thereafter, the dispersion is applied onto the inner peripheral surface of the nickel alloy base layer 12, followed by drying and baking.

By using the polyimide varnish as the first polyimide resin material 52, a good adhesiveness can be obtained without subjecting both of the second polyimide resin material 51 and the nickel alloy base layer 12 to a particular surface treatment.

Further, by coating the second polyimide resin material 51 on the nickel alloy base layer 12 after being mixed with the first polyimide resin material 52, the first polyimide resin material 52 is covered with the second polyimide resin material 51. For this reason, the second polyimide resin material 51 does not readily directly contact the nickel alloy base layer 12. As a result, points of contact of the second polyimide resin material 51 and the nickel alloy base layer 12 between which an adhesiveness is not generated are reduced, so that the resin layer 11 is not readily parted from the base surface of the nickel alloy base layer 12.

As the polyimide resin material used as the first and second polyimide resin materials, polyimide resin materials which are formed by reaction of polyimide precursors of aromatic tetracarboxylic acid and aromatic diamine and which are difference in combination of the acid and the amine, and the like polyimide resin material can be used. Examples of the aromatic tetracarboxylic acid may include pyromellitic dianhydride; 3,3',4,4'-biphenyltetracarboxylic dianhydride; 3,3',4,4'-benzophenonetetracarboxylic dianhydride; and 2,3,6,7-naphthalenetetracarboxylic dianhydride. Examples of the aromatic diamine may include paraphenylenediamine and benzidine.

Further, the polyimide varnish (first polyimide resin material) is a mixture of the above-described polyimide precursor with an organic polar solvent such as dimethylacetamide, dimethylformamide, N-methyl-2-pyrrolidone, phenol, or o-, m- or p-cresol.

Structural formulas of the polyimide resin materials in this embodiment are shown below (A)

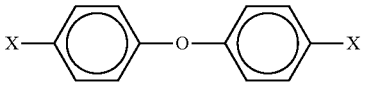

(B)

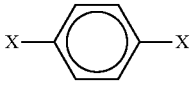

(C)

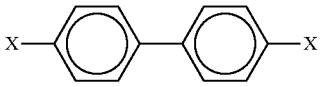

In the above formulas (A), (B) and (C), X represents any one of the following groups

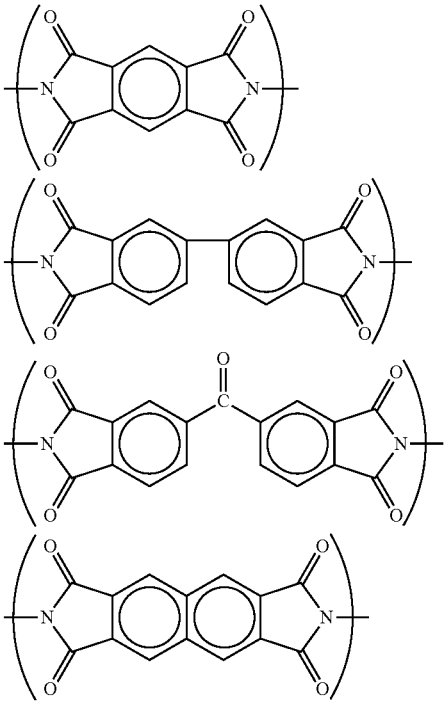

For example, a polyimide resin material obtained from a polyimide precursor of (a combination of) 3,3',4,4'-biphenyltetracarboxylic dianhydride and 4,4'-diaminodiphenyl ether is represented by the structural formula (A). The polyimide resin material represented by such a structural formula (A) is available as U-varnish A and UIP-R (both are trade names of UBE INDUSTRIES, LTD.). Further, polyimide resin materials obtained from polyimide precursors of 3,3',4,4'-biphenyltetracarboxylic dianhydride and paraphenylene diamine are represented by the structural formulas (B) and (C). The polyimide resin materials represented by such structural formulas (B) and (C) are available as U-varnish S and UIP-S (both are trade names of UBE INDUSTRIES, LTD.).

An ether bond (linkage) portion contained in the structure of the formula (A) has a high degree of freedom of rotation and therefore an aggregate containing the either bond portion can be expected that it exhibits extensibility. Further, the structures of the formulas (B) and (C) have a rigid molecular structure and therefore aggregates containing the structures can be expected that elasticity thereof is improved. For this reason, polyimide resin powder (particles) as the first polyimide resin material 51 and the polyimide varnish as the second polyimide resin material 52 are made different in structural formula from each other, so that a mechanical strength of the second polyimide resin material 51 can be made higher than that of the first polyimide resin material 52. For example, a mixing ratio of the polyimide resin material of the formula (A) with the polyimide resin material of the formula (B) or (C) is changed. As a result, it is possible to obtain the polyimide resin material which is changed and optimized in friction (sliding) wearing property depending on desired functions, so that the second and first polyimide resin materials 51 and 52 can be formed depending on the sliding member for the resin layer 11.

Such a polyimide resin material can be coated on the inner peripheral surface of the nickel alloy base layer 12 by a known method such as dipping or ring coating. In this embodiment, the ring coating as shown in FIG. 4 is used. In a ring coating device 20 shown in FIG. 4, parallel struts 201 and 202 are provided on a base 21. On the strut 201, a coating head 22*a* is fixed and to which a coating liquid supplying device (not shown) is connected. The coating head 22*a* is formed in a cylindrical shape in which a supplying path from the coating liquid supplying device is disposed at a central portion and a plurality of slits parallel to the strut 201 is formed at its outer peripheral surface. Further, a plurality of branch paths are form radially from the supplying path toward the plurality of slits. Therefore, the coating liquid (polyimide precursor solution) supplied from the coating liquid supplying device is discharged from the slits so as to cover the outer peripheral surface of the coating head 22*a*.

By the strut 202, a work moving device 26 is supported movably along the strut 202. The work moving device 26 is vertically moved in FIG. 4 along the strut 202 by rotational drive of a motor 27 provided on the strut 202. At an end of the work moving device 26, a work hand 25 for holding the nickel alloy base layer 12 is disposed. Therefore, the nickel alloy base layer 12 held by the work hand 25 is vertically moved in FIG. 4 together with the work hand 25 by the work moving device 26.

In order to coat the coating liquid onto the inner peripheral surface of the nickel alloy base layer 12, the nickel alloy base layer 12 is moved along the outer peripheral surface of the coating head 22*a* while supplying the polyimide precursor solution as the coating liquid from the coating liquid supplying device to the outer peripheral surface of the coating head 22*a*. As a result, the coating liquid can be applied substantially uniformly over the whole inner peripheral surface of the nickel alloy base layer 12.

Incidentally, the resin layer 11 is required that a ratio of the diameter (average particle size) of the first polyimide resin material 51 to the layer thickness of the first polyimide resin material 52 is 100% to 200% but this range can be realized by adjusting a coating amount of the polyimide precursor mixture (solution). In the coating device, an arbitrary coating amount can be obtained by changing, e.g., a moving speed of the work.

After the coating, through steps of drying and baking, the resin layer 11 is formed on the inner peripheral surface of the nickel alloy base layer 12. The drying and the baking are also not particularly limited, but a commercially available ready-made circulating hot air oven can be used. Incidentally, the baking temperature is not more than the heat-resistant temperature of the nickel alloy base layer 12. As a result, as described above, the degree of imidization of the first polyimide resin material 52 is determined.

According to this embodiment, the second polyimide resin material 51 having the high mechanical strength is projected from the inner peripheral surface of the first polyimide resin material 52 having coated on the inner peripheral surface of the nickel alloy base layer 12, and therefore the portion of the second polyimide resin material 51 slides with the sliding member. Further, the second polyimide resin material 51 can be formed, separately from the first polyimide resin material 52, at the high baking temperature to increase the mechanical strength, and the first polyimide resin material 52 in which the first polyimide resin material 51 is distributed can be baked at the low temperature. That is, the first polyimide resin material 51 can be baked at the temperature which is not more than the heat-resistant temperature (e.g., 250° C.) of the nickel alloy base layer 12. For this reason, even in the case where the nickel alloy is used as a material for the base material of the belt, the anti-wearing property of the belt at the inner peripheral surface can be sufficiently ensured.

[Experiment]

An experiment conducted for checking an effect of the present invention will be described by using Table 1 below. In each of Embodiments 1 and 2 and Comparative Embodiments 1 and 2, durability of a heat-resistant belt based on actual-machine evaluation and abrasion amount of the resin layer based on sample evaluation were checked.

TABLE 1

| | | EMB. 1 | EMB. 2 | COMP. EMB. 1 | COMP. EMB. 2 |
|---|---|---|---|---|---|
| 1ST PRM*1 | TYPE*2 | UVS | UVS | UVS | UVA |
| | DOI*3 (%) | 70 | 70 | 72 | 72 |
| | LH*4 (μm) | 6-7 | 9-10 | 6-7 | 6-7 |
| 2ND PRM*5 | TYPE*2 | UIP-S | UIP-R | — | — |
| | DOI*3 (%) | 100 | 100 | — | — |
| | LH*4 (μm) | 7-12 | 10-15 | — | — |
| APS/LT*7 | (%) | 100-200 | 100-166 | — | — |
| AME*8 | RESULT*9 | OK | OK | NG1 | NG2 |
| | IT*10 (N) | 0.53 | 0.55 | 0.54 | 0.53 |
| | ET*11 (N) | 1.8 | 0.8 | 3.2 | 2.8 |
| SE*12 | AA*13 (μm) | 1.8 | 0.8 | 3.2 | 2.8 |

*1"1ST PRM" is the first polyimide resin material.
*2With respect to "TYPE", "UVS" is U-varnish S and "UVA" is U-varnish A.
*3"DOI" is the degree of imidization.
*4"LT" is the layer thickness.
*5"2ND PRM" is the second polyimide resin material.
*6"APS" is the average particle size.
*7"APS/LH" is the ratio of the average particle size to the layer thickness.
*8"AME" is the actual machine evaluation.
*9"RESULT" is an evaluation result. "OK" represents that there is no problem even after 300,000 sheets. "NG1" represents that the torque exceeds 0.75 N/m at 30,000 sheets. "NG2" represents that the belt is broken at 25,000 sheets.
*10"IT" is an initial torque.
*11"ET" is an end torque.
*12"SE" is the sample evaluation.
*13"AA" is the abrasion amount.

Examples 1 and 2 and Comparative Embodiments 1 and 2 will be described.

[Embodiment 1]

As the nickel alloy base layer 12, a nickel alloy base layer formed of nickel-iron and having an inner diameter of 30 mm, a thickness of 40 mm and a length of 420 mm was used. As the second polyimide resin material 51, UIP-S (trade name, UBE INDUSTRIES, LTD., average particle size: 7-12 μm) was used. As the first polyimide resin material 52, U-varnish S (trade name, UBE INDUSTRIES, LTD., solid content: 20%) was used. In U-varnish S, 1 wt. % of UIP-S was mixed and then the mixture was applied onto the inner peripheral surface of the nickel alloy base layer 12 in a thickness of 30-35 μm. Thereafter, the resultant layer was dried at 120° C. for 10 minutes and baked at 230° C. for 30 minutes. As a result, the resin layer 11 in which the average particle size of the second polyimide resin material 51 is 100%-200% of the layer thickness of the polyimide resin material 52 was formed on the inner peripheral surface of the nickel alloy base layer 12. Further, the first polyimide resin material 52 was 70% in degree of imidization and 6-7 μm in layer thickness, and the second polyimide resin material 51 was 100% in degree of imidization.

Then, on the outer peripheral surface of the nickel alloy base layer 1, as the elastic layer, a silicone rubber layer of 300 μm in thickness was formed. Further, the surface layer 15 of PFA and 50 μm in thickness was formed by a method of coating and bonding with an addition type silicone rubber adhesive.

[Embodiment 2]

The nickel alloy base layer 12 is the same as that in Embodiment 1. As the second polyimide resin material 51, UIP-S (trade name, UBE INDUSTRIES, LTD., average particle size: 10-15 μm) was used. As the first polyimide resin material 52, U-varnish S (trade name, UBE INDUSTRIES, LTD., solid content: 20%) was used. In U-varnish S, 1 wt. % of UIP-R was mixed and then the mixture was applied onto the inner peripheral surface of the nickel alloy base layer 12 in a thickness of 45-50 μm. Thereafter, the resultant layer was dried at 120° C. for 10 minutes and baked at 230° C. for 30 minutes. As a result, the resin layer 11 in which the average particle size of the second polyimide resin material 51 is 100%-166% of the layer thickness of the polyimide resin material 52 was formed on the inner peripheral surface of the nickel alloy base layer 12. Further, the first polyimide resin material 52 was 70% in degree of imidization and 9-10 μm in layer thickness, and the second polyimide resin material 51 was 100% in degree of imidization.

Further, UIP-S used as the second polyimide resin material 51 contains the structure of the formula (A), and U-varnish S used as the first polyimide resin material 52 contains the structure of the formula (B) or (C). Therefore, the resin layer 11 containing components different in structural formula was obtained. With respect to other layers, the same layers as those in Embodiment 1 were formed to obtain a fixing belt.

[Comparative Embodiment 1]

Without mixing the second polyimide resin material 51, U-varnish S as the first polyimide resin material 52 was applied in a thickness of 50-55 μm onto the inner peripheral surface of the nickel alloy base layer 12. Thereafter, the resultant layer was dried at 120° C. for 10 minutes and baked at 230° C. for 30 minutes. As a result, the resin layer, free from the particles of the second polyimide resin material 51, of 72% in degree of imidization and 6-7 μm in thickness was formed. With respect to other layers, the same layers as those in Embodiment 1 were formed to obtain a fixing belt.

[Comparative Embodiment 2]

Without mixing the second polyimide resin material 51, U-varnish A as the first polyimide resin material 52 was applied in a thickness of 50-55 μm onto the inner peripheral surface of the nickel alloy base layer 12. Thereafter, the resultant layer was dried at 120° C. for 10 minutes and baked at 230° C. for 30 minutes. As a result, the resin layer, free from the particles of the second polyimide resin material 51, of 72% in degree of imidization and 6-7 μm in thickness was formed. With respect to other layers, the same layers as those in Embodiment 1 were formed to obtain a fixing belt.

[Actual Machine Evaluation]

Each of the fixing belts 41 of Embodiments 1 and 2 and Comparative Embodiments 1 and 2 was mounted in the fixing apparatus as shown in FIG. 1 and was subjected to a durability test in the following manner. First, the fixing belt 41 of each of Embodiments 1 and 2 and Comparative Embodiments 1 and 2 was rotated by rotation of the pressing roller 45 in a state, in which the pressing roller 45 was pressed against the fixing belt 41 under predetermined pressure, while controlling a heater thickness of the fixing belt 41 at 230° C.

As the pressing roller 45, a roller obtained by coating a 3 mm-thick silicone rubber elastic layer with a 30 μm-thick PFA tube to have a diameter of 25 mm was used. Further, the pressure was 300 N, and the nip 46 was 8 mm in width and 310 mm in length. A surface speed of the fixing belt 41 was set at 210 mm/sec. Further, in order to improve slip between the ceramic heater 43 and the inner peripheral surface of the fixing belt 41, a lubricant (trade name: "HP300", mfd. by Dow Corning Corporation) was applied in a total amount of 1.0 g. Further, a driving torque of the pressing roller 45 required to rotate the fixing belt 41 was measured.

With abrasion (wearing) of the inner peripheral surface of the fixing belt 41, abrasion powder is stagnated at the nip 46 and as a result, the function of the lubricant is lowered and thus a load torque of the pressing roller 45 is increased. In the case where the load torque exceeds 0.75 N/m, by friction between the inner peripheral surface of the fixing belt 41 and the sliding surface of the ceramic heater 43, the fixing belt 41 during sheet passing cannot be smoothly rotated by the pressing roller 45, so that improper conveyance of the recording material is generated in some cases. For this reason, in the durability test, a time until the load torque exceeds 0.75 N/m or until the fixing belt is broken was determined as a durability time (the number of sheets subjected to passing).

A minimum durability time in consideration of a process speed and factor of safety of the image heating apparatus is required to be 300,000 sheets and therefore when the number of sheets exceeds 300,000 sheets, the durability test was ended at the time of exceeding 300,000 sheets.

[Sample Evaluation of Abrasion Amount]

A part of the inner peripheral surface of the fixing belt of each of Embodiments 1 and 2 and Comparative Embodiments 1 and 2 is used as a sample rubbing portion, and an anti-wearing property of each resin layer was evaluated by using a linear reciprocating sliding test machine ("Friction Player FRP-2100", mfd. by Rhesca Corporation). As a contactor, a commercially available abrasive paper (Abrasive Sheet C947H, #1000, mfd. by Noritake Coated Abrasive Co., Ltd.) cut in 5×5 mm was used. Then, the abrasive paper was contacted to the surface of the resin layer in an environment of a set temperature 200° C. (actually measured result: 185° C.), a sliding test was conducted under a condition of 1.0 N in load, 200 mm/sec in speed, 30 mm in width and 300 times in reciprocation. Thereafter, the abrasive paper is removed and then the sample rubbing portion is cleaned with dry non-woven fabric. This operation was repeated ten times, and a change in film (layer) thickness before and after the operation was measured.

As is apparent from the above-shown Table 1, in the actual machine evaluation, the load torque exceeded 0.75 N/m at 30,000 sheets in Comparative Embodiment 1, and the fixing belt was broken at 25,000 sheets in Comparative Embodiment 2. On the other hand, in Embodiments 1 and 2 having the constitutions according to the present invention, there was no problem even when the number of sheets exceeded 300,000 sheets. Further, in the same evaluation, the abrasion amount was smaller in Embodiments 1 and 2 than that in Comparative Embodiments 1 and 2. From the above, it can be checked that the constitutions of the present invention were excellent in durability.

[Other Embodiments]

In the above-described embodiments, an example in which the ceramic heater has two functions consisting of a function of the urging member (urging pad) and a function of heating the fixing belt is described but the present invention is similarly applicable to also, e.g., a constitution in which the urging member and the heating mechanism are separately provided. Specifically, there is the case where an IH heating source using an exciting coil as the heating mechanism for heating the fixing belt is used and in addition, the urging member (urging pad) is used separately from the heating source.

Further, in addition to the example of the fixing apparatus, the present invention is similarly applicable to also a gloss-improving apparatus (image heating apparatus) for improving glossiness of an image by re-hating a toner image which has already been fixed on the recording material. In this case, the fixing belt functions as a heating belt.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 022280/2012 filed Feb. 3, 2012, which is hereby incorporated by reference.

What is claimed is:

1. A fixing belt comprising:

a base layer formed of a nickel alloy; and a surface layer provided on said base layer, said surface layer having a thickness and being formed of a first polyimide resin material, wherein said surface layer comprises a filler dispersed therein and having an average particle size not less than the thickness, and wherein the filler is formed of a second polyimide resin material.

2. A fixing belt according to claim 1, wherein the second polyimide resin material has a degree of imidization higher than that of the first polyimide resin material.

3. A fixing belt according to claim 2, wherein the degree of imidization of the second polyimide resin material is 95% or more, and the degree of imidization of the first polyimide resin material is 70% or more and 90% or less.

4. A fixing belt according to claim 1, wherein the average particle size of the filler is not more than two times the thickness.

5. A fixing apparatus comprising:

a fixing belt for fixing an image on a sheet at a fixing nip;

a nip-forming member for forming the fixing nip between itself and said fixing belt; and an urging member for urging said fixing belt toward said nip-forming member, wherein said fixing belt includes a base layer formed of a nickel alloy, and a surface layer provided on said base layer, said surface layer having a thickness and being formed of a first polyimide resin material, wherein said surface layer comprises a filler dispersed therein and having an average particle size not less than the thickness, and wherein the filler is formed of a second polyimide resin material.

6. A fixing apparatus according to claim 5, wherein the second polyimide resin material has a degree of imidization higher than that of the first polyimide resin material.

7. A fixing apparatus according to claim 6, wherein the degree of imidization of the second polyimide resin material is 95% or more, and the degree of imidization of the first polyimide resin material is 70% or more and 90% or less.

8. A fixing apparatus according to claim 5, wherein the average particle size of the filler is not more than two times the thickness.

* * * * *